US009074858B2

(12) United States Patent
Yee et al.

(10) Patent No.: US 9,074,858 B2
(45) Date of Patent: Jul. 7, 2015

(54) PROJECTILE-DEPLOYED COUNTERMEASURE SYSTEM

(71) Applicant: The Boeing Company, Chicago, IL (US)

(72) Inventors: Dennis Yee, Mill Creek, WA (US); Timothy L. Williams, Burien, WA (US)

(73) Assignee: The Boeing Company, Chicago, IL (US)

( * ) Notice: Subject to any disclaimer, the term of this patent is extended or adjusted under 35 U.S.C. 154(b) by 221 days.

(21) Appl. No.: 13/682,256

(22) Filed: Nov. 20, 2012

(65) Prior Publication Data

US 2014/0216290 A1 Aug. 7, 2014

Related U.S. Application Data

(60) Provisional application No. 61/671,297, filed on Jul. 13, 2012.

(51) Int. Cl.

| | |
|---|---|
| ***F42B 15/10*** | (2006.01) |
| ***F42B 12/56*** | (2006.01) |
| ***F41H 11/02*** | (2006.01) |
| ***F41H 13/00*** | (2006.01) |
| ***F41F 3/04*** | (2006.01) |
| ***F42B 15/00*** | (2006.01) |
| ***F42B 15/01*** | (2006.01) |

(52) U.S. Cl.

CPC ..... *F42B 12/56* (2013.01); *F41H 11/02* (2013.01); *F41H 13/0006* (2013.01); *F41F 3/04* (2013.01); *F42B 15/00* (2013.01); *F42B 15/01* (2013.01)

(58) Field of Classification Search

CPC ..... F41H 5/026; F41H 11/02; F41G 13/0006
USPC ..... 244/3.1, 121; 89/36.07, 36.08, 36.11; 342/62, 67
See application file for complete search history.

(56) References Cited

U.S. PATENT DOCUMENTS

| | | | | |
|---|---|---|---|---|
| 2,251,918 A | * | 8/1941 | Dawson | 102/504 |
| 3,568,191 A | * | 3/1971 | Hiester et al. | 342/8 |
| 4,231,311 A | * | 11/1980 | Longerich | 114/244 |
| 4,492,166 A | * | 1/1985 | Purcell | 102/384 |
| 4,912,869 A | | 4/1990 | Govett | |

(Continued)

FOREIGN PATENT DOCUMENTS

GB 2172853 A 3/1985

OTHER PUBLICATIONS

GB Combined Search and Examination Report dated May 18, 2012 in GB Application No. GB1201328.0.

(Continued)

*Primary Examiner* — Samir Abdosh
(74) *Attorney, Agent, or Firm* — Baldauff IP, LLC; Michael J. Baldauff, Jr.

(57) ABSTRACT

Systems and methods described herein provide for the protection of personnel within vehicles and structures from rocket-propelled grenades and other incoming threats. According to one aspect of the disclosure provided herein, a countermeasure system includes an interceptor vehicle configured to stow and launch an expandable countermeasure. The countermeasure may have a flexible body with attached deployment mechanisms that expand the flexible body into the path of an incoming threat to capture the threat.

12 Claims, 6 Drawing Sheets

(56) References Cited

U.S. PATENT DOCUMENTS

| | | | | |
|---|---|---|---|---|
| 5,750,918 | A * | 5/1998 | Mangolds et al. | 102/502 |
| 5,898,125 | A * | 4/1999 | Mangolds et al. | 102/439 |
| 5,988,036 | A * | 11/1999 | Mangolds et al. | 86/1.1 |
| 6,430,108 | B1 * | 8/2002 | Pignol et al. | 367/145 |
| 6,626,077 | B1 * | 9/2003 | Gilbert | 89/1.11 |
| 6,957,602 | B1 * | 10/2005 | Koenig et al. | 89/1.11 |
| 7,066,427 | B2 * | 6/2006 | Chang | 244/3.19 |
| 7,190,304 | B1 * | 3/2007 | Carlson | 342/62 |
| 7,202,809 | B1 * | 4/2007 | Schade et al. | 342/67 |
| 7,328,644 | B2 * | 2/2008 | Vickroy | 89/1.11 |
| 7,398,617 | B2 | 7/2008 | Mattox | |
| 7,412,916 | B2 * | 8/2008 | Lloyd | 89/1.11 |
| 7,786,417 | B2 * | 8/2010 | Sells, II | 244/3.1 |
| 8,122,810 | B2 * | 2/2012 | Glasson | 89/1.11 |
| 8,205,537 | B1 * | 6/2012 | Dupont | 89/1.34 |
| 8,399,816 | B2 * | 3/2013 | Glasson | 244/3.1 |
| 2002/0134365 | A1 | 9/2002 | Gray | |
| 2006/0169832 | A1 * | 8/2006 | Glasson | 244/3.1 |
| 2007/0169616 | A1 | 7/2007 | Vickroy | |
| 2007/0261542 | A1 * | 11/2007 | Chang et al. | 89/1.11 |
| 2010/0307328 | A1 | 12/2010 | Hoadley et al. | |
| 2012/0210851 | A1 | 8/2012 | Glasson | |
| 2014/0033907 | A1 * | 2/2014 | Martinez et al. | 89/1.11 |

OTHER PUBLICATIONS

Non-Final Office Action dated Jan. 10, 2013 in U.S. Appl. No. 13/016,608.

Shenzhen Xinyi Technology Co., Ltd., "Air-charged Catching Net," [http://www.ecplaza.net/trade-leads-seller/aircharged-catching-net--6447638.html] Accessed Jun. 20, 2012.

CoolestGadgets, "Shooting Net for Catching Thieves," [http://www.coolest-gadgets.com/20080402/shooting-net-for-catching-thieves/] Accessed Jun. 20, 2012.

Instructables, "Build a Net Gun," [http://www.instructables.com/id/Build-A-Net-Gun/] Accessed Jun. 20, 2012.

Tactical Life, "Net Gun," [http://www.tactical-life.com/online/special-weapons/net-gun/] Accessed Jun. 20, 2012.

* cited by examiner

PROJECTILE-DEPLOYED COUNTERMEASURE SYSTEM

CROSS REFERENCE TO RELATED APPLICATIONS

This application claims the benefit of U.S. Provisional Application No. 61/671,297 filed Jul. 13, 2012 entitled "Projectile-Deployed Countermeasure System," which is expressly incorporated herein by reference.

BACKGROUND

Military personnel may be faced with numerous types of threats from hostile parties. Rocket-propelled grenades (RPGs) are often a weapon of choice for hostile parties. RPGs typically consist of a rocket with a warhead attached and may be launched from a handheld launcher. RPGs may be effective against armored vehicles, helicopters, and structures. The relatively low cost, portability, and lethality of the weapon makes RPGs a formidable threat to friendly forces.

One method for guarding against these types of threats is to attempt to destroy an incoming RPG with an explosive force and/or fragments from a defensive rocket or weapon. These types of defensive weapons are designed to intercept the incoming RPG and destroy the rocket via impact, explosion, or fragments or other debris from exploding the defensive weapon in close proximity to the RPG. Similarly, existing solutions include utilizing fixed barriers or rapidly deployable barriers to fixed structures or vehicles in an effort to contact and prematurely detonate the incoming RPG prior to contact with the intended target. One drawback to these types of defensive weapons and fixed barrier solutions is that the explosions and resulting shrapnel from these weapons or from the exploding RPG have the potential to damage friendly structures, vehicles, or to injure friendly personnel or innocent bystanders.

Another existing solution to an RPG attack includes utilizing a projectile or other countermeasure to dud the warhead by crushing the nose cone of the incoming RPG to short out the fuse coupled to the warhead. This method may be effective against dated RPGs that rely on the nose cone to supply electrical current to the fuse of the weapon. However, more recent RPGs utilize insulated electrical wires that prevent this type of electrical short when the nose cone is crushed or damaged.

Other solutions attempt to catch or detonate an incoming RPG utilizing a structure that is attached or otherwise fixed to a defensive projectile. For example, a rigid or semi-rigid barrier may be deployed from a forward portion of a countermeasure rocket to engage an incoming RPG. However, because of the nature of these barriers and because of the attachment location on the forward portion of the rocket, these countermeasure systems may be destabilizing to the rocket at deployment. To overcome the stability issues the size, weight, and corresponding cost and complexity of these systems may be significant.

Similarly, other countermeasure rockets may tow a barrier behind the intercepting rocket in order to engage the incoming RPG. However, towing barriers behind a rocket creates an inordinate amount of drag that slows the rocket, potentially preventing interception of the incoming RPG at a safe distance from the aircraft, vehicle, or structure being protected. This towed configuration additionally requires a larger rocket motor, which may increase the size, cost, and complexity of the countermeasures system. Additionally, there may be a potential for the exhaust gases from the countermeasure rocket to burn through a portion of the towed barrier, reducing the effectiveness of the system.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Systems and methods described herein provide for the effective protection of a vehicle or other platform from an incoming RPG or similar threat. Utilizing the concepts described herein, an incoming threat can be detected and an interceptor vehicle launched to intercept the incoming threat at a safe distance from the vehicle or platform being protected. The interceptor vehicle deploys a detachable net or similarly expanding countermeasure to intercept and capture the incoming RPG or threat prior to impact with the vehicle.

According to one aspect of the disclosure provided herein, a countermeasure system may include an interceptor vehicle having a propulsion system and a countermeasure compartment. The interceptor vehicle may be launched from a countermeasure launcher on or near the vehicle or other asset being protected. The countermeasure system may further include a countermeasure configured to be stowed within and launched from the countermeasure compartment of the interceptor vehicle. The countermeasure may include a flexible receiving body that expands when deployed for capturing the incoming threat.

According to another aspect, a method for neutralizing an incoming threat is provided. The method may include detecting the incoming threat approaching the vehicle or other asset to be protected and launching an interceptor vehicle to intercept the incoming threat. A countermeasure may be deployed from the interceptor vehicle. A flexible receiving body of the countermeasure may expand in the path of the incoming threat to capture and neutralize the threat.

According to another aspect, a countermeasure system may include a countermeasure launcher, an interceptor vehicle, and a countermeasure. The countermeasure may include a flexible receiving body with a number of deployment mechanisms attached around the perimeter of the flexible receiving body. The interceptor vehicle may include a propulsion system with an exhaust nozzle, and a countermeasure compartment around the exhaust nozzle for stowing the countermeasure. A number of detachable panels may be positioned around the countermeasure compartment to encompass the countermeasure within prior to deployment of the countermeasure. An electronics system of the interceptor vehicle may be configured to release the detachable panels to deploy the countermeasure. The countermeasure system may further include a threat detection and launch system in communication with the electronics system of the interceptor vehicle. The threat detection and launch system may be operative to detect the incoming threat, launch the interceptor vehicle, guide the interceptor vehicle to the incoming threat, and provide instructions for deployment of the countermeasure.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The present disclosure is illustrated by way of example and not limitation in the figures of the accompanying drawings, in which like references indicate similar elements and in which.

DETAILED DESCRIPTION

Figure 1A:
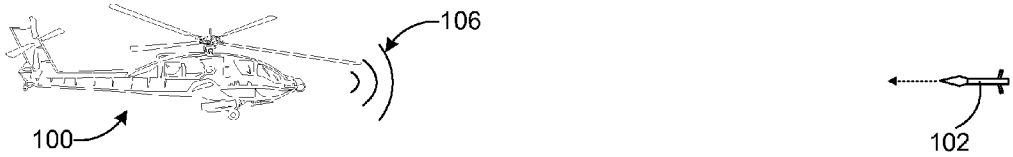
FIGS. 1A-1E are elevational views of a countermeasure system being deployed to intercept an incoming threat according to embodiments presented herein.

The following detailed description is directed to systems and methods for detecting and neutralizing an incoming threat such as a rocket-propelled grenade (RPG). As discussed briefly above, RPGs typically consist of a rocket with a warhead attached and may be launched from a handheld launcher. Due to the low cost, portability, and lethality of the weapon, RPGs are a threat to friendly forces in structures and vehicles. Existing solutions may detonate the incoming RPGs, creating further risk of collateral damage, or require relatively large and complex intercept rockets due to the drag created by the attached countermeasure.

However, utilizing the concepts and technologies described herein, helicopters, ground-based vehicles, structures, and any other friendly asset may be protected with a system that detects an incoming RPG and launches an interceptor vehicle on a trajectory or flight path that passes in close proximity to the incoming threat. At a designed location with respect to the incoming RPG, the interceptor vehicle deploys a countermeasure from the interceptor vehicle. The interceptor vehicle continues past the incoming RPG, while the deployed countermeasure expands outward into the path of the RPG. The RPG flies into the deployed countermeasure. The opposing momentums of the RPG and the countermeasure, as well as the additional drag of the countermeasure encompassing the RPG, causes the incoming RPG to miss the target and typically fall harmlessly to the ground short of the intended target or to veer off of the intended flight path.

In the following detailed description, references are made to the accompanying drawings that form a part hereof, and which are shown by way of illustration, specific embodiments, or examples. Referring now to the drawings, in which like numerals represent like elements through the several figures, a countermeasure system and method will be described. FIGS. 1A-1E show an illustrative view of a countermeasure system mounted to a vehicle 100 and deployed to intercept an RPG 102 or other incoming threat that is approaching the vehicle 100. According to this example and others throughout this disclosure, the incoming threat may be an RPG 102. However, it should be understood that the incoming threat may be any grenade, rocket, projectile, or even non-lethal object that is approaching the vehicle 100 or target. So, although the following disclosure will depict and describe the incoming threat as being an RPG 102 for illustrative purposes, the embodiments described herein are not limited to any particular threat prevention and are equally applicable to the protection of any target.

Additionally, although the various figures and corresponding disclosure describe the countermeasure system as being installed on a vehicle 100, such as the helicopter depicted in FIGS. 1A-1E, it should be noted that the countermeasure system may be used with any type of target, such as a ground-based vehicle or fixed structure, in which protection from an incoming RPG 102 or other similar threat is desirable. Looking at FIG. 1A, this example implementation shows an RPG 102 targeting a helicopter, or vehicle 100. Threat detection system onboard the vehicle 100 detects the incoming RPG 102, as indicated by sensor detection lines 106. As will be further described below with respect to FIG. 2, the detection system may include any conventional radar or other threat detection equipment.

Figure 1B:
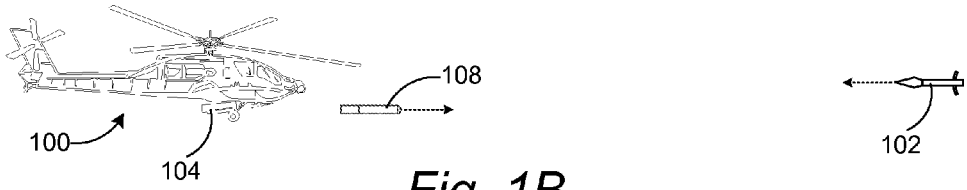
Figure 1C:
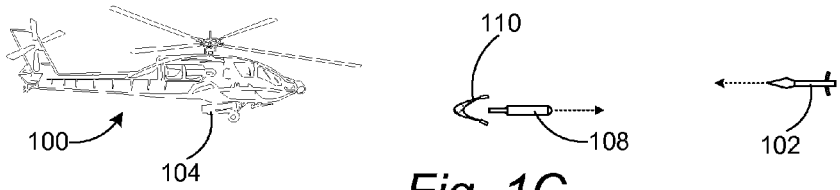

As shown in FIG. 1B, in response to the detection of the RPG 102, the countermeasure system mounted on, within, or adjacent to the vehicle 100 fires an interceptor vehicle 108 from a countermeasure launcher 104. As will be described in greater detail below, the interceptor vehicle 108 may include a rocket, missile, mortar, or other projectile, guided or unguided. FIG. 1C shows the countermeasure 110 being deployed from a rear portion of the interceptor vehicle 108. The countermeasure 110 may include a flexible net, fabric, or mesh-like material of sufficient strength to capture or otherwise deflect the incoming RPG 102. The countermeasure 110 will be described in greater detail with respect to FIG. 5.

Figure 1D:
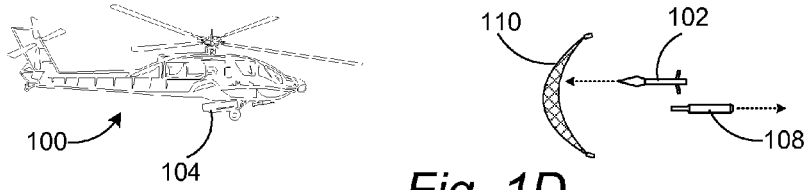

FIG. 1D shows the countermeasure 110 expanding into a fully deployed configuration within the path of the RPG 102. The expansion from the stowed configuration within the interceptor vehicle 108 to the fully deployed configuration for capturing the RPG 102 may occur via centrifugal force from the rotation of the interceptor vehicle 108 and/or via any number and type of deployment mechanisms within the interceptor vehicle 108 or attached to any number of locations around the perimeter of the countermeasure 110 as described in further detail below with respect to FIG. 5. According to one embodiment, the interceptor vehicle 108 continues past the RPG 102 after deploying the countermeasure 110 until running out of fuel.

Figure 1E:
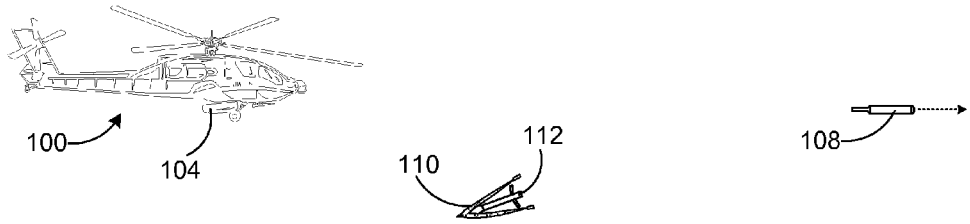

FIG. 1E shows the captured RPG 112 that has been encompassed by the countermeasure 110. Upon contact, the countermeasure 110 wraps around or encompasses the RPG 102. The captured RPG 112 then falls harmlessly to the ground a safe distance from the vehicle 100 or other intended target. Depending on the momentum associated with the RPG 102 and the countermeasure 110, the captured RPG 112 may be deflected from its path to the target so as to fall forward, approximately straight down, or rearward with respect to its direction of movement at the location of intercept.

According to one embodiment, the RPG 102 may partially penetrate a mesh material of the countermeasure 110, but without traversing completely through the countermeasure 110, effectively slowing the RPG 102 or altering the course of the RPG 102, preventing the RPG 102 from reaching the vehicle 100 without detonating its warhead. According to another embodiment, the RPG 102 may be detonated by the impact with the countermeasure 110, but at a sufficient distance from the vehicle 100 so as to prevent damage to the vehicle 100 and associated personnel. Throughout this disclosure, the countermeasure system is described as a "projectile-deployed countermeasure system." It should be understood that this label is used to convey that the countermeasure 110 described herein is stowed within, and deployed from, a projectile (interceptor vehicle 108) launched from a launcher.

Figure 2:
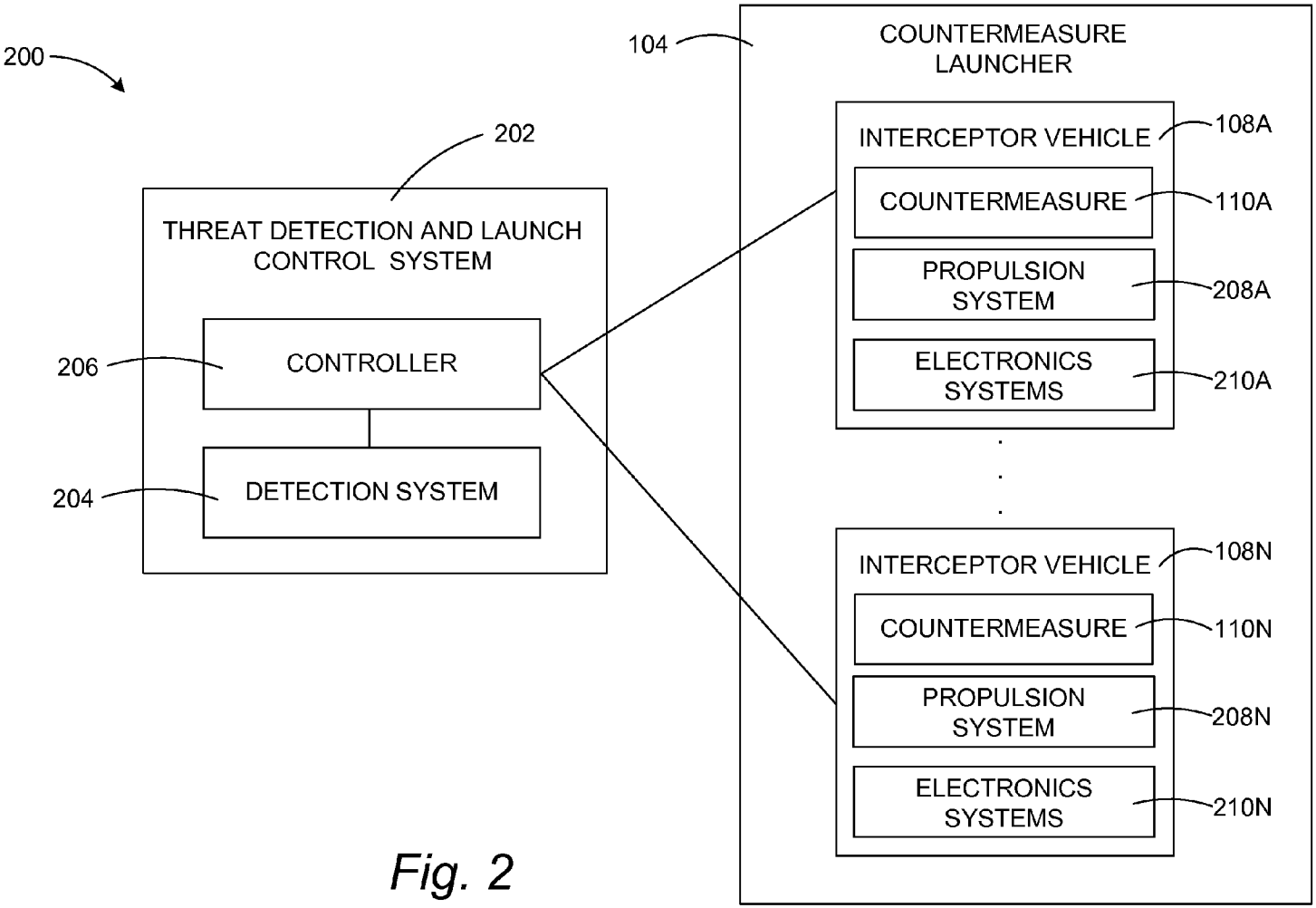
FIG. 2 is a block diagram of a countermeasure system showing the various components of the system according to one embodiment presented herein.

Turning to FIG. 2, the components of a countermeasure system 200 will be described. As described above, the countermeasure system 200 includes at least one countermeasure launcher 104. Although only one countermeasure launcher 104 is shown for clarity purposes, a vehicle 100 or other structure may have any number of countermeasure launchers 104 installed. Each countermeasure launcher 104 may have the capability to carry and launch any number of interceptor vehicles 108A-108N. According to one embodiment, a helicopter may have two countermeasure launchers 104 installed, each with the capability to launch four to six interceptor vehicles 108. Ground structures and ground-based vehicles may have any appropriate number of countermeasure launchers 104. Because size and weight is not as much of a limitation when protecting ground structures or even ground-based vehicles as compared with protecting aircraft, countermeasure launchers 104 for use with structures and ground-based vehicles may have the capability to launch a greater number of interceptor vehicles 108 per launcher (e.g., eight interceptor vehicles 108).

The countermeasure system 200 also includes a threat detection and launch control system 202 that is used to detect an incoming threat 102, to select the appropriate countermeasure launcher 104 for neutralizing the threat, and to launch one or more interceptor vehicle 108. According to one embodiment, the threat detection and launch control system 202 includes a detection system 204 and a controller 206.

The detection system 204 may include any radar system, lidar system, optical or acoustic-based sensors, electro-optical and/or infrared systems, and/or any technology suitable for detecting the presence of an object approaching the vehicle 100. According to one embodiment, the detection system 204 includes a millimeter wave and/or microwave wide field of view (FOV) radar system. According to one embodiment, the radar system for use with aircraft such as the helicopter or vehicle 100 may have a 180-degree FOV capability. According to another embodiment, the radar system for use with ground-based vehicles or structures may have a 120-degree FOV capability. The radar system may utilize any number of antennas located at any suitable location on the vehicle 100 or other structure. According to various embodiments, the detection system 204 incorporates existing radar and threat detection systems currently employed in existing helicopters or other vehicles 100.

It should also be appreciated that the threat detection and launch control system 202 may include a manual launch mechanism such as a button or switch (not shown) that enables an operator to manually launch one or more interceptor vehicles 108 prior to or without threat detection from the detection system 204. According to this embodiment, should the interceptor vehicle 108 be guided, the controller 206 may guide the interceptor vehicle 108 to the incoming RPG 102 when acquired by radar or may be manually guided to the threat by the operator. With an unguided interceptor vehicle 108, the operator may manually deploy the countermeasure 110 when desired via a corresponding button or switch (not shown) that activates a deployment signal sent to the interceptor vehicle 108.

The controller 206 may be any computer hardware and/or software containing computer executed instructions for receiving threat detection data from the detection system 204 and, in response, selecting the appropriate countermeasure launchers 104 and corresponding interceptor vehicles 108 for neutralizing the incoming threat 102. The controller 206 is operative to determine and provide a firing solution to the electronics systems 210A-210N (collectively referred to as 210) of the appropriate interceptor vehicles 108. The firing solution may include guidance data for directing the interceptor vehicle 108 to the target and countermeasure deployment information that provides instructions as to when the countermeasure 110 is to be deployed or released from the interceptor vehicle 108.

It should be appreciated that the concepts described herein may not only be used to launch a protective interceptor vehicle 108 from the vehicle 100 that is being targeted by the incoming RPG 102, but also to launch an interceptor vehicle 108 from a vehicle 100 to intercept an RPG 102 that is targeting another vehicle 100, structure, or other target. In these implementations, the guidance data from the firing solution may include instructions for the interceptor vehicle 108 to perform a turn or heading change to provide proper alignment of the countermeasure 110 with the RPG 102 when deployed from the interceptor vehicle 108.

According to one embodiment, the countermeasure deployment information may instruct the electronics systems 210 of the corresponding interceptor vehicle 108 to deploy the countermeasure 110 after a determined number of rotations of the interceptor vehicle 108 after launch. According to an alternative embodiment, the instructions may trigger deployment of the countermeasure 110 after a determined time lapse after launch.

According to yet another alternative embodiment, the instructions may be provided by the controller or may be pre-stored on computer-readable storage media onboard the interceptor and may instruct the electronics systems 210 to deploy the countermeasure 110 within a determined distance from the protected asset or a determined proximity to the RPG 102. The determined distance may correspond to a distance from the vehicle 100 or other protected asset in which the detonation of an incoming RPG 102 or other threat would not cause any damage, taking into account any applicable variables such as flight characteristics of the incoming RPG 102, interceptor vehicle 108, and vehicle 100; deployment characteristics of the interceptor vehicle 108 and corresponding countermeasure 110; as well as typical explosive characteristics and damage radius predictions associated with a detonation of the incoming RPG.

The proximity of the interceptor vehicle 108 to the incoming RPG 102 may be detected by an onboard proximity sensor on the interceptor vehicle 108 or other conventional radar or suitable detection system. Alternatively, the proximity of the interceptor vehicle 108 to the RPG 102 may be determined from the detection system 204 associated with the vehicle 100 and transmitted to the interceptor vehicle 108 before or after launch of the interceptor vehicle 108. According to various embodiments, the threat detection and launch control system 202 may instruct the electronics systems 210 of the interceptor vehicle 108 to deploy the countermeasure 110 at a time or distance determined according to the speed of the incoming RPG 102. The countermeasure 110 deployment may be triggered according to the number of revolutions of the interceptor vehicle 108 or according to a time delay based on the speed of the incoming RPG 102 and corresponding distance from the vehicle 100.

Figure 3A:
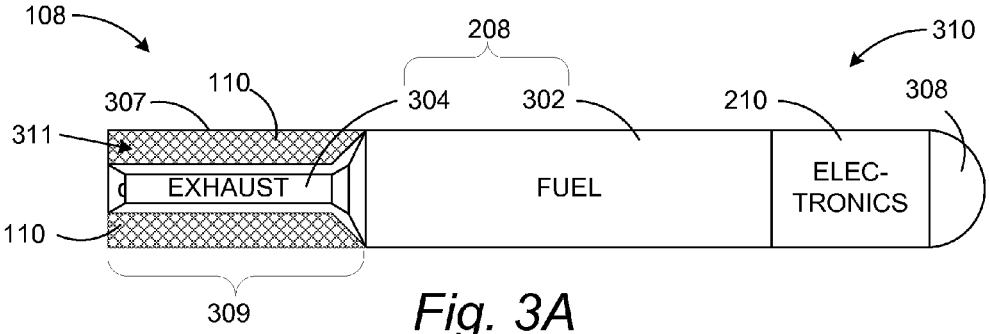
FIG. 3A is a cross-sectional side view of an interceptor vehicle in a pre-deployment configuration according to one embodiment presented herein.
Figure 3B:
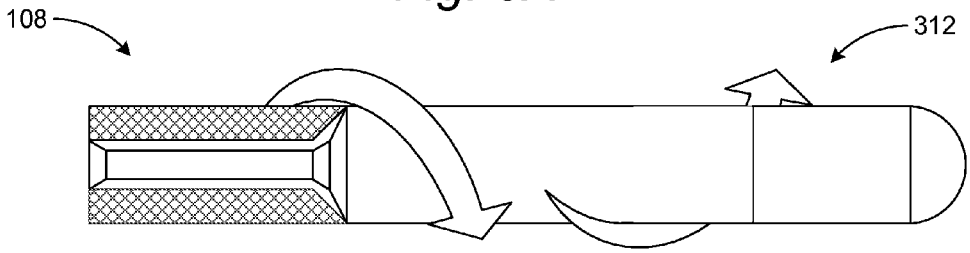
FIG. 3B is a cross-sectional side view of an interceptor vehicle in an in-flight configuration showing rotational movement during threat intercept according to one embodiment presented herein.
Figure 3C:
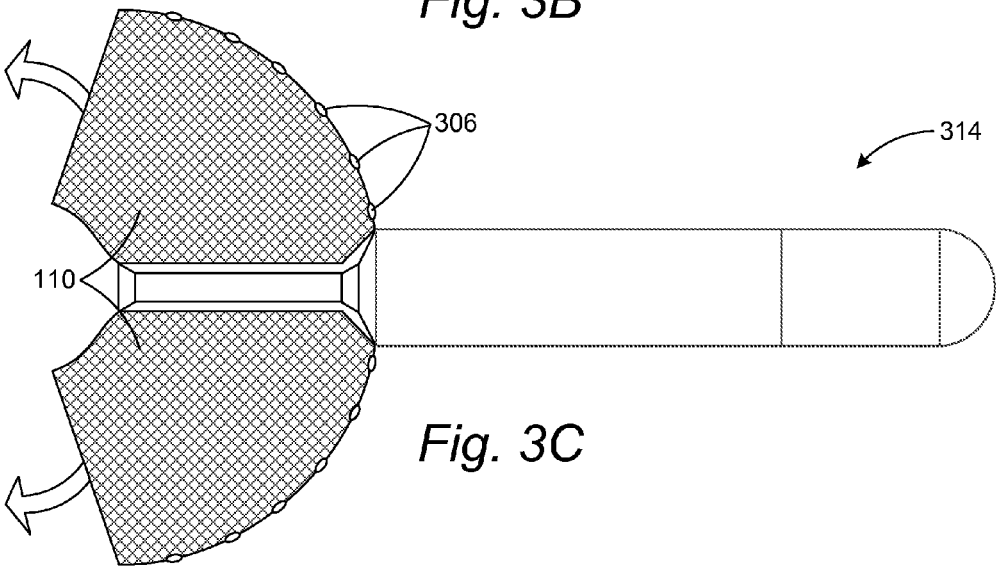
FIG. 3C is a cross-sectional side view of an interceptor vehicle in a deployment configuration during deployment of a countermeasure according to one embodiment presented herein.

As mentioned above, each countermeasure launcher 104 may be loaded with any number of interceptor vehicles 108A-108N. According to one embodiment, the interceptor vehicles 108A-108N may include corresponding countermeasures 110A-110N, propulsion systems 208A-208N (collectively referred to as 208), and electronic systems 210A-210N. Turning now to FIGS. 3A-3C, these components will be described in greater detail.

FIG. 3A shows a cross-sectional view of an interceptor vehicle 108 in a pre-deployment configuration 310 according to one embodiment. In this example, the interceptor vehicle 108 is generally cylindrical in shape with an aerodynamic nose cone 308. The interceptor vehicle 108 has a compartment for the electrical systems 210 described above. As mentioned, the electrical systems 210 may include any type of guidance, communication, power, or other components utilized to communicate with the threat detection and launch control system 202 and to initiate deployment of the countermeasure 110 at the appropriate time to intercept an incoming RPG 102.

The propulsion system 208 may include components for propelling the interceptor vehicle 108 from the countermeasure launcher 104 to the RPG 102. As seen in FIG. 3A, the propulsion system 208 may include a compartment or tank for the fuel 302, such as a solid fuel propellant, as well as an exhaust nozzle 304. Any appropriate type and quantity of fuel 302 may be used, as well as any exhaust nozzle 304 configuration according to the designed flight parameters of the interceptor vehicle 108.

According to various embodiments, the countermeasure 110 may be stowed in a countermeasure compartment 311 at a rear portion 309 of the interceptor vehicle 108 surrounding the exhaust nozzle 304. The countermeasure compartment 311 may be bordered on the outside by one or more detachable panels 307 and on the inside by the exhaust nozzle 304 or associated components. The countermeasure 110 may be wrapped, folded, or otherwise configured to stow within the countermeasure compartment 311 under one or more detachable panels 307 surrounding the rear portion 309 of the interceptor vehicle 108. Although the countermeasure compartment 311 is shown and described as being positioned at the rear portion 309 of the interceptor vehicle, it should be appreciated that the countermeasure compartment 311 may be positioned at a middle or forward portion of the interceptor vehicle without departing from the scope of this disclosure.

When the electronics systems 210 trigger the deployment of the countermeasure 110, the detachable panels 307 are ejected via electro-mechanical, explosive, or other means. With the detachable panels ejected, the countermeasure 110 is free to deploy as described in greater detail below. It should be appreciated that the precise dimensions and other parameters of the interceptor vehicle 108 may be dependent upon the characteristics of the desired countermeasure 110 and the speed and distance at which the interceptor vehicle 108 is to deliver and deploy the countermeasure 110, among other design criteria.

FIG. 3B illustrates an in-flight configuration 312 of the interceptor vehicle 108. The large open arrows around the interceptor vehicle 108 of FIG. 3B are used to illustrate one embodiment of the interceptor vehicle 108 in which the interceptor vehicle 108 is stabilized during flight via a rotational spin around its longitudinal axis. The spin may be induced by nozzle vanes or other elements associated with the exhaust nozzle 304, rifling in the countermeasure launcher 104, or any other conventional means. This spin may not only stabilize the interceptor vehicle 108, but aid in deployment of the countermeasure 110, as seen in FIG. 3C.

FIG. 3C shows a deployment configuration 314 in which the countermeasure 110 is being deployed from the rear portion 309 of the interceptor vehicle 108. According to various embodiments, any type and number of deployment mechanisms 306 may be secured to one or more edges or portions of the countermeasure 110 to assist with full deployment and expansion of the countermeasure 110. Various deployment mechanisms 306 will be described in detail below with respect to FIG. 5. As one example, the deployment mechanisms 306 may include a number of weights or weighted elements secured around the perimeter of the countermeasure 110. When the detachable panels 307 are ejected to initiate deployment of the countermeasure 110, the centrifugal force from the rotation of the interceptor vehicle 108 causes the weights around the perimeter of the countermeasure 110 to move outwards. The outward movement of the weighted elements effectively expands the countermeasure 110 to a fully deployed configuration. The rotation of the weights continues as the countermeasure 110 is fully deployed. This persistent rotation enables the countermeasure 110 to remain open for longer periods of time than if the countermeasure 110 were not rotating. The rotational additionally provides a stabilizing effect for the countermeasure 110. The result is a countermeasure 110 that remains expanded and in place within the flight path of the incoming RPG 102 for a relatively large period of time to maximize the chances of a successful capture of the RPG 102

Figure 3D:
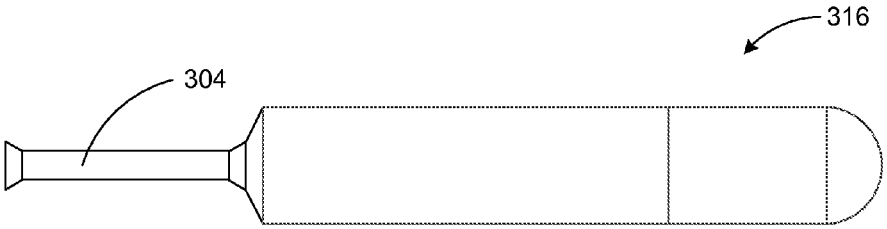
FIG. 3D is a cross-sectional side view of an interceptor vehicle in a post-deployment configuration after deployment of a countermeasure according to one embodiment presented herein.

FIG. 3D shows the post-deployment configuration 316 of the remaining interceptor vehicle 108 after the countermeasure 110 has deployed away from the interceptor vehicle 108 and captured the incoming RPG 102. Because the countermeasure 110 is fully detachable from the interceptor vehicle 108 rather than being fixed to or towed by the projectile, the size, weight, and corresponding cost of the interceptor vehicle 108 may be minimized.

Figure 4A:
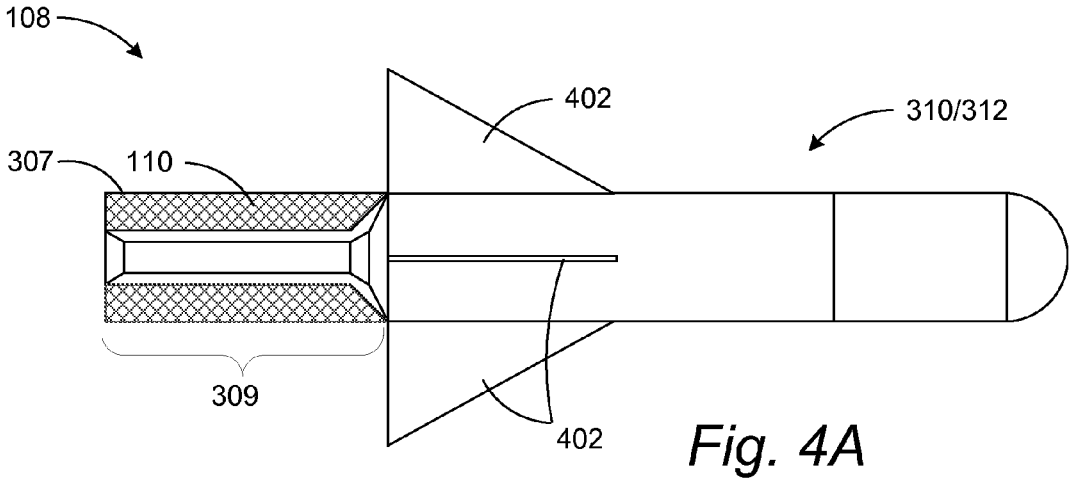
FIG. 4A is a cross-sectional side view of an interceptor vehicle utilizing stabilizing fins in a pre-deployment configuration according to one embodiment presented herein.
Figure 4B:
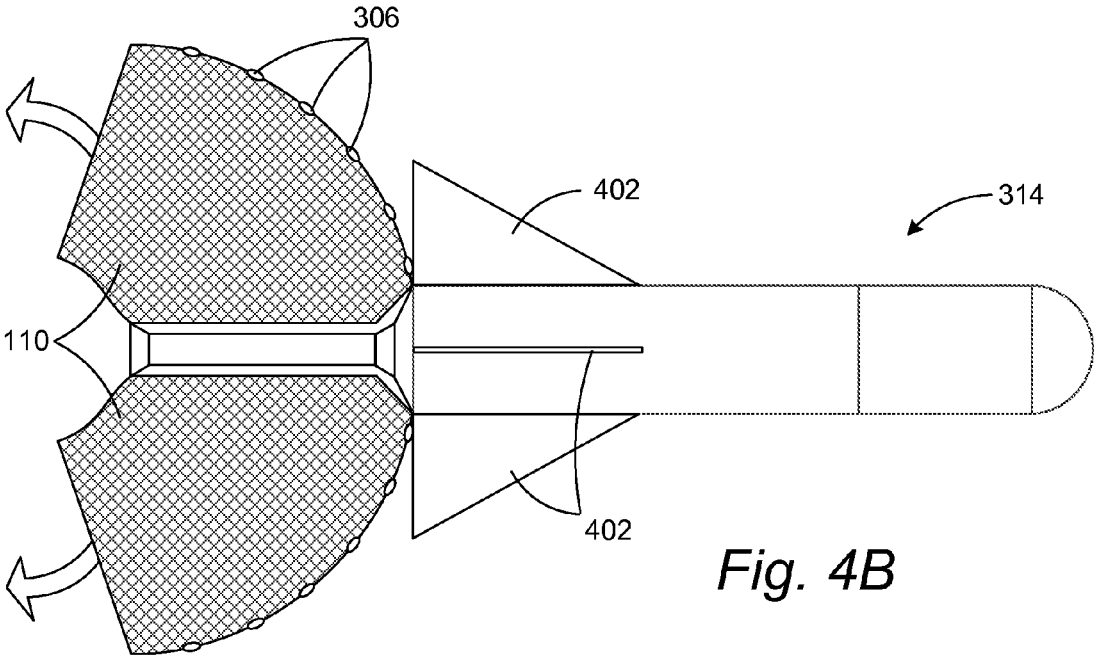
FIG. 4B is a cross-sectional side view of an interceptor vehicle with stabilizing fins in a deployment configuration during deployment of a countermeasure according to one embodiment presented herein.

FIG. 4A shows another embodiment of an interceptor vehicle 108 in pre-deployment and in-flight configurations 310 and 312, respectively. FIG. 4B shows the interceptor vehicle 108 of this embodiment in a deployment configuration 314. In this embodiment, the interceptor vehicle 108 utilizes stabilizing fins 402 rather than rotational motion to stabilize the interceptor vehicle 108 during flight. The stabilizing fins 402 of this embodiment may be placed proximate to the rear portion 309 of the interceptor vehicle 108, but forward of the detachable panels 307 that contain the countermeasure 110 within. By placing the stabilizing fins 402 forward of the detachable panels 307, the fins will not interfere with the ejection of the detachable panels 307 or the deployment of the countermeasure 110, as shown in FIG. 4B. Additionally, the stabilizing fins 402 may be canted to produce the rotational flight characteristics of the interceptor vehicle 108 described above with respect to FIG. 3B.

Alternatively, a rear portion of the stabilizing fins 402 may extend rearward over the stowed countermeasure 110, but with the rear portion of the stabilizing fins remaining unattached to the interceptor vehicle 108 so as to prevent interference with the countermeasure 110 deployment. It should be appreciated that the precise shape, dimensions, number, and placement of the stabilizing fins 402 may vary according to the particular application and are not limited to those shown in FIGS. 4A and 4B.

Figure 5:
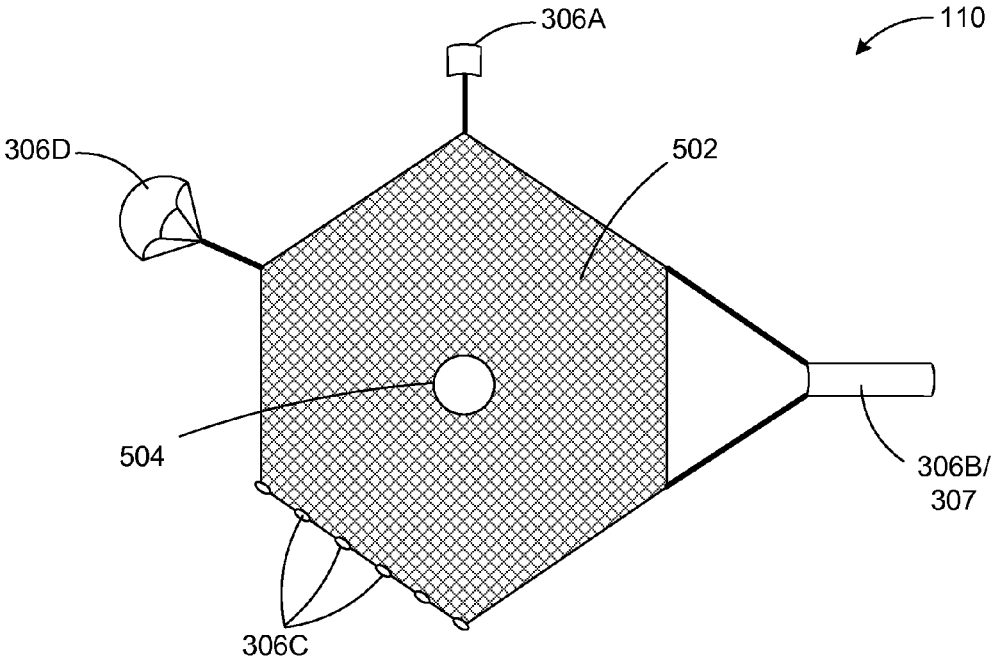
FIG. 5 is a top view of an expanded countermeasure showing various deployment mechanisms according to various embodiments presented herein.

FIG. 5 shows a top view of a countermeasure 110 in an expanded, fully deployed configuration with different deployment mechanisms 306A-306D shown as examples according to various embodiments. As shown in FIG. 5, the countermeasure 110 includes a flexible receiving body 502 with deployment mechanisms 306 attached to multiple locations around the perimeter of the flexible receiving body 502. The flexible receiving body 402 may be made from any material capable of being folded or compressed into a stowed configuration (shown in FIGS. 1B, 3A, and 4A) and expanded to a deployed configuration (shown in FIGS. 1D and 5), while having sufficient material strength to capture or detonate an RPG 102 or other incoming threat when deployed from an interceptor vehicle 108. Suitable examples of receiving body materials include, but are not limited to, various types of lightweight metals, carbon fiber filaments, monofilament line, nylon, polyethylene, ultra high molecular weight polyethylene, as well as various other polymers, composites and metals, either alone or in combination. The precise material strength values can be easily determined using known techniques. The flexible receiving body 502 may be made from a netting or mesh material that provides the desired strength, minimizes the size of the countermeasure 110 when stowed, and reduces air resistance when deployed. A similar countermeasure is shown and described in related co-pending U.S. patent application Ser. No. 13/016,608, filed on Jan. 28, 2011, which is incorporated herein in its entirety.

While the shape of the countermeasure 110 as viewed in the deployed configuration from the top is shown in FIG. 5 to be hexagonal, it should be understood that the shape may be circular, oval, or may contain any number of sides, symmetric or asymmetric. The countermeasure 110 may lay flat when fully expanded, or may have depth so as to create a "pocket" in the flexible receiving body 502. According to one embodiment, the flexible receiving body 502 includes a stowage aperture 504 approximately central to the countermeasure 110. This aperture allows the countermeasure 110 to be threaded onto the rear portion 309 of the interceptor vehicle 108 around the exhaust nozzle 304 and folded or wrapped into stowage underneath the detachable panels 307.

As seen in FIGS. 1C and 1D, because the flight path of the interceptor vehicle 108 may be offset slightly from the incoming flight path of the RPG 102 in order to pass the RPG 102 rather than impact the RPG 102 with the interceptor vehicle 108, the RPG 102 is likely to enter the flexible receiving body 502 at a position that is offset from the center of the countermeasure 110. Accordingly, the stowage aperture 504 does not provide a means through which the RPG 102 is likely to escape the countermeasure 110. Moreover, the offset entry of the RPG 102 into the flexible receiving body 502 may assist in rapidly altering the flight path of the RPG 102 as the deployment mechanisms 306 on opposite sides of the flexible receiving body 502 will close around the RPG 102 at different rates due to the offset location of entry of the RPG 102 into the countermeasure 110, creating an angular momentum that will rotate the RPG 102 and orient it off of its intended course.

As stated above, there are numerous types of deployment mechanisms 306 contemplated by this disclosure. Various example deployment mechanisms 306A-306D are shown in FIG. 5 for illustrative purposes. It should be understood that this disclosure is not limited to the types and characteristics of the deployment mechanisms 306A-306D shown and described here. Rather, any type and number of elements may be used to expand the flexible receiving body 502 via centrifugal force, aerodynamic drag or lift, or any other appropriate means.

The deployment mechanism 306A may include a weight or weighted element that is attached either directly or via a tether to the flexible receiving body 502. With this implementation, any number of deployment mechanisms 306A may be attached to the corners or periphery of the flexible receiving body 502. These weights may be shaped or contoured to facilitate stowage around the exhaust nozzle 304 of the interceptor vehicle 108. The precise size and weight of the deployment mechanisms 306A (as well as all other deployment mechanisms 306) may be minimized to values that allow for rapid expansion after deployment of the countermeasure 110, while minimizing the stowage space and corresponding payload weight of the interceptor vehicle 108.

The deployment mechanism 306B may be similar to deployment mechanism 306A. However, the deployment mechanism 306B illustrates how attachment to multiple corners or locations on the periphery of the flexible receiving body 502 is possible. Additionally, it is contemplated that the deployment mechanism 306B may include the detachment panel 307. In this embodiment, the detachment panels 307 on the interceptor vehicle 108 may be tethered or otherwise attached to locations around the perimeter of the flexible receiving body 502 of the countermeasure 110. In this manner, when the detachment panels 307 are ejected, wind resistance and/or the weight of the panels coupled with centrifugal force causes the detachment panels 307 to move outward, expanding the flexible receiving body 502 into the fully deployed configuration.

The deployment mechanism 306C utilizes multiple weights of any number, shape, and size attached directly to multiple locations around the perimeter of the flexible receiving body 502. In this embodiment, numerous smaller weights as compared to those discussed above with respect to deployment mechanism 306A are contemplated and are coupled directly to the edge of the countermeasure 110.

The deployment mechanism 306D utilizes small parachutes or other high drag devices attached at multiple locations around the perimeter of the flexible receiving body 502. These small parachutes inflate when exposed to the ambient airflow and operate to pull the countermeasure 110 into the deployed configuration. This particular deployment mechanism 306D may be particular useful if used with the interceptor vehicle 108 having stabilizing fins 402 rather than rotational stabilizing flight. It should be appreciated that any of these and other deployment mechanisms 306A-306D may be used alone or in combination with one another depending on the particular implementation. A benefit of using drag enhancements such as the parachutes described above is that they continue to act on the RPG 102 until its forward motion stops. After capturing the RPG 102, the small parachutes or other drag enhancements continue to assist in slowing the RPG 102 until impact well short of the intended target.

Figure 6:
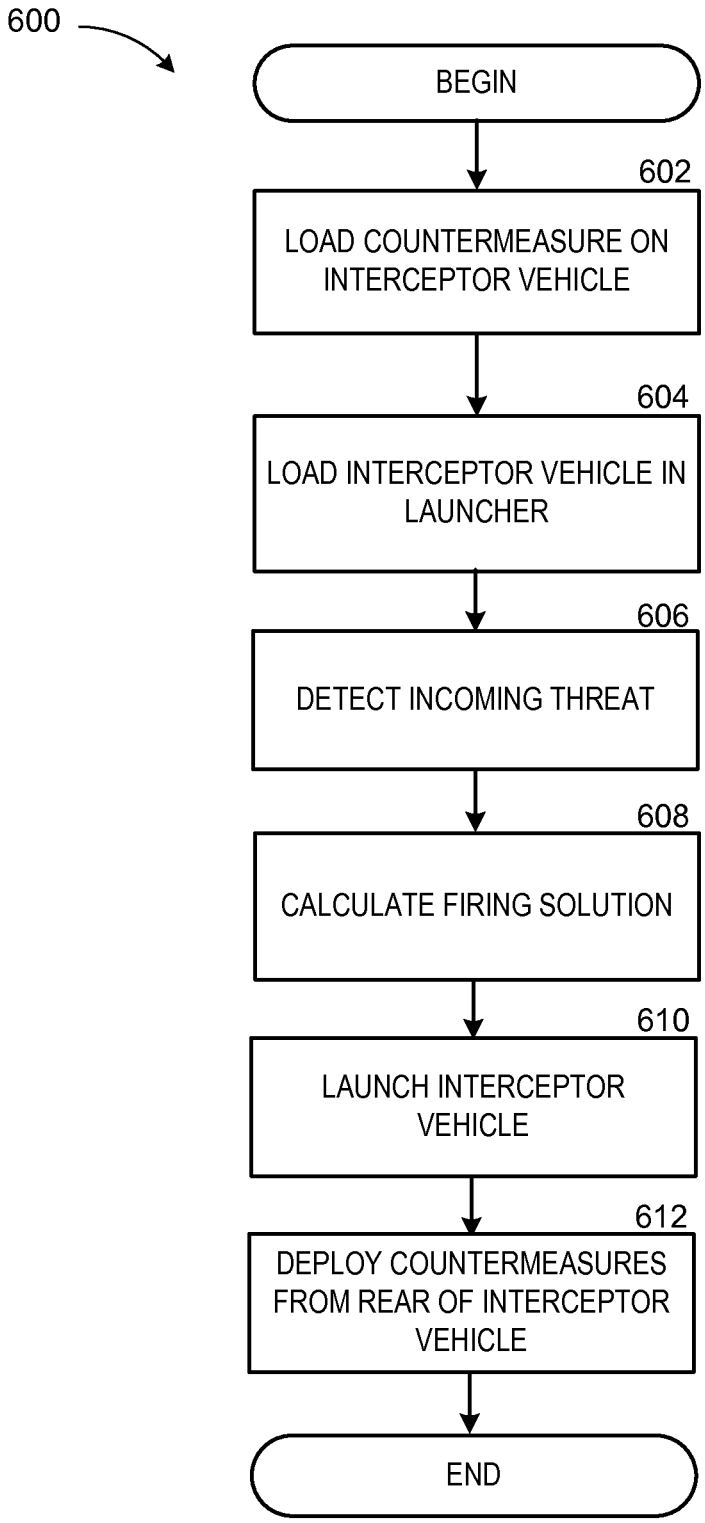
FIG. 6 is a flow diagram illustrating a method for neutralizing an incoming threat with a projectile-deployed countermeasure according to various embodiments presented herein.

Turning to FIG. 6, an illustrative routine 600 for neutralizing an incoming threat with a projectile-deployed countermeasure system will now be described in detail. It should be appreciated that more or fewer operations may be performed than shown in the FIG. 6 and described herein. Moreover, these operations may also be performed in a different order than those described herein. The routine 600 begins at operation 602, where the countermeasure 110 is loaded on the interceptor vehicle 108. As described above, this may be include threading the rear portion 309 of the interceptor vehicle 108 through the stowage aperture 504 of the countermeasure 110 and folding or wrapping the flexible receiving body 502 and corresponding deployment mechanisms 306 into place and securing with the detachable panels 307 of the interceptor vehicle 108.

From operation 602, the routine 600 continues to operation 604, where the interceptor vehicle 108 is loaded into the countermeasure launcher 104. At operation 606, an RPG 102 or other incoming threat is detected. The detection may occur with the detection system 204, such as a radar system, or may be a visual detection from an occupant of the vehicle 100. At operation 706, the controller 206 determines the applicable approach zone of the incoming threat 102.

The routine 600 continues from operation 606 to operation 608, where a firing solution is calculated by the controller 206. The firing solution may be calculated using any amount and type of data corresponding to the incoming RPG 102. Examples include but are not limited to the size, type, position, velocity, vector, acceleration, time to impact, or any other applicable or desirable data associated with the RPG 102 or other incoming threat. The firing solution is used to launch the interceptor vehicle 108 at operation 610. At operation 612, the electronics systems 210, either autonomously after receiving the firing solution from the controller 206 pre-launch or upon receiving real-time instructions from the controller 206 during threat intercept, triggers the ejection of the detachable panels 307 and subsequent deployment of the countermeasure 110 at the determined time and location. The deployment of the countermeasure 110 results in the capture of the RPG 102 and the routine 600 ends.

For illustrative purposes only, an example scenario will now be described to show how a countermeasure system 200 described herein might be employed to detect and neutralize an incoming threat as illustrated in FIGS. 1A-1E. Looking back at FIGS. 1A-1E, the illustrative example will be described in detail. It should be appreciated that the exact specifications of a countermeasure system 200, to include the timing, velocities, and distances described with respect to this example, may vary according to the particular implementation of the countermeasure system 200. This example is not intended to be limiting.

According to this example, as shown in FIG. 1A, the incoming threat 102, which is an RPG, is fired at the vehicle 100, which is the helicopter, at time=0 seconds. The threat detection and launch control system 202 of a countermeasure system 200 installed in the helicopter detects the RPG firing, begins tracking the RPG, and slews the countermeasure launcher 104 toward the RPG at approximately time=0.2 seconds. At time=0.38 seconds, the radar track to the RPG is finalized, the time to impact is calculated, and the intercept range is calculated. This countermeasure deployment information is transmitted to the electronics systems 210 of the interceptor vehicle 108. AT time=0.42 seconds, the interceptor vehicle 108 is launched from the countermeasure launcher 104, as shown in FIG. 1B.

FIG. 1C shows a time=0.57 seconds in which the countermeasure 110 is deployed from the interceptor vehicle 108, approximately 30 meters from the helicopter. FIG. 1D shows a time=0.69 seconds at which the countermeasure 110 is fully deployed in the path of the incoming RPG, which is approximately 62 meters from the helicopter. At a time=0.85 seconds, the RPG impacts the flexible receiving body 502 of the countermeasure 110, becomes entangled, and slows. FIG. 1E shows the RPG at an approximately time=1 second in which the RPG has deviated from its intended course by approximately 10-15 meters, is oriented off course by approximately 50-90 degrees, missing the targeted helicopter. It should again be understood that the timelines presented in this example are for illustrative purposes only and may vary significantly dependent upon various factors, including but not limited to, the launch range of the incoming threat 102, the desired intercept range, and the threat detection method (e.g., passive threat warning versus active radar).

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A countermeasure system, comprising:

an interceptor vehicle comprising a propulsion system, a countermeasure compartment, a plurality of detachable panels encompassing the countermeasure compartment, and an electronics system operative to release the detachable panels to deploy a countermeasure, the interceptor vehicle configured for launch from a countermeasure launcher;

the countermeasure comprising a flexible receiving body and configured for detachable stowage within the countermeasure compartment of the interceptor vehicle; and a threat detection and launch control system comprising:

a detection system operative to detect an incoming threat, and a controller operative to launch the interceptor vehicle, guide the interceptor vehicle to intercept the incoming threat, and provide instructions to the electronics system to release the plurality of detachable panels after a determined number of rotations of the interceptor vehicle after launch.

2. The countermeasure system of claim 1, wherein the interceptor vehicle comprises a rocket or a missile having an exhaust nozzle, wherein the countermeasure compartment surrounds at least a portion of the exhaust nozzle.

3. The countermeasure system of claim 1, further comprising the countermeasure launcher, wherein the countermeasure launcher is configured to stow and launch a plurality of interceptor vehicles.

4. The countermeasure system of claim 1, wherein the interceptor vehicle is configured to rotate around a longitudinal axis of the interceptor vehicle during flight.

5. The countermeasure system of claim 1, wherein the interceptor vehicle further comprises a plurality of stabilizing fins positioned adjacent to the countermeasure compartment.

6. The countermeasure system of claim 1, wherein the countermeasure further comprises a plurality of deployment mechanisms secured to the flexible receiving body and configured to expand the flexible receiving body during deployment.

7. The countermeasure system of claim 6, wherein the plurality of deployment mechanisms comprises a plurality of weighted elements such that centrifugal force from rotation of the interceptor vehicle projects the plurality of weighted elements outward to expand the flexible receiving body during deployment of the countermeasure.

8. The countermeasure system of claim 6, wherein the plurality of deployment mechanisms comprises a plurality of high drag devices configured to pull the flexible receiving body open when exposed to ambient airflow during deployment of the countermeasure.

9. The countermeasure system of claim 6, wherein the plurality of deployment mechanisms comprises a plurality of detachable panels encompassing the countermeasure compartment.

10. A method for neutralizing an incoming threat, comprising:

detecting the incoming threat;

launching an interceptor vehicle to intercept the incoming threat; and deploying a countermeasure from the interceptor vehicle such that the countermeasure releases and separates from the interceptor vehicle, the countermeasure comprising a flexible receiving body and a plurality of weighted elements coupled to a perimeter of the flexible receiving body, wherein deploying the countermeasure comprises releasing a plurality of detachable panels surrounding a countermeasure compartment stowing the countermeasure such that the countermeasure is exposed to ambient airflow around the interceptor vehicle, allowing centrifugal force to expel the plurality of weighted elements outward to expand the flexible receiving body configured to expand when released from the interceptor vehicle to capture the incoming threat.

11. A countermeasure system, comprising:

a countermeasure launcher;

a countermeasure comprising a flexible receiving body, a plurality of deployment mechanisms coupled to a perimeter of the flexible receiving body;

an interceptor vehicle configured for launch from the countermeasure launcher and comprising a propulsion system comprising an exhaust nozzle, a countermeasure compartment at least partially encompassing the exhaust nozzle and configured to receive the countermeasure, a plurality of detachable panels encompassing the countermeasure compartment, an electronics system operative to release the plurality of detachable panels during deployment of the countermeasure;

a threat detection and launch system communicatively coupled to the electronics system and operative to detect an incoming threat, launch the interceptor vehicle, guide the interceptor vehicle to a position for deployment of the countermeasure, and provide instructions to the electronics system such that the electronics system releases the plurality of detachable panels to deploy the countermeasure according to the instructions.

12. A method for neutralizing an incoming threat, comprising:

detecting the incoming threat;

launching an interceptor vehicle to intercept the incoming threat; and deploying a countermeasure from the interceptor vehicle such that the countermeasure releases and separates from the interceptor vehicle, the countermeasure comprising a flexible receiving body and a plurality of high drag devices coupled to a perimeter of the flexible receiving body, wherein deploying the countermeasure comprises releasing a plurality of detachable panels surrounding a countermeasure compartment stowing the countermeasure such that the countermeasure is exposed to ambient airflow around the interceptor vehicle, allowing the plurality of high drag devices to pull the flexible receiving body open to capture the incoming threat.

* * * * *